US009676002B2

(12) United States Patent
Guillemin

(10) Patent No.: US 9,676,002 B2
(45) Date of Patent: Jun. 13, 2017

(54) GOLD PANNING ASSEMBLY

(71) Applicant: Kenneth Guillemin, Angels Camp, CA (US)

(72) Inventor: Kenneth Guillemin, Angels Camp, CA (US)

( * ) Notice: Subject to any disclaimer, the term of this patent is extended or adjusted under 35 U.S.C. 154(b) by 40 days.

(21) Appl. No.: 14/796,064

(22) Filed: Jul. 10, 2015

(65) Prior Publication Data

US 2017/0008035 A1 Jan. 12, 2017

(51) Int. Cl.

| | |
|---|---|
| ***B03B 5/06*** | (2006.01) |
| ***B07B 13/08*** | (2006.01) |
| ***B07B 13/00*** | (2006.01) |
| ***B07B 13/11*** | (2006.01) |
| *B03B 5/04* | (2006.01) |

(52) U.S. Cl.
CPC ..... *B07B 13/08* (2013.01); *B03B 5/06* (2013.01); *B07B 13/003* (2013.01); *B07B 13/113* (2013.01); *B03B 5/04* (2013.01)

(58) Field of Classification Search
CPC ..... B03B 5/04; B03B 5/06; B03B 5/26
USPC ..... 209/44, 44.2, 446, 479, 490, 494, 506
See application file for complete search history.

(56) References Cited

U.S. PATENT DOCUMENTS

| | | | | |
|---|---|---|---|---|
| 1,948,797 | A * | 2/1934 | Nicolai | B03B 5/02 209/275 |
| 4,319,994 | A * | 3/1982 | Morgan | B03B 5/02 209/447 |
| 4,517,079 | A * | 5/1985 | Cleland | B03B 5/74 209/444 |
| 4,561,346 | A | 12/1985 | Marquer | |
| 5,190,158 | A * | 3/1993 | Remias | B03B 5/02 209/397 |
| 5,213,200 | A | 5/1993 | Fishman et al. | |
| 5,275,294 | A * | 1/1994 | Krenzler | B07B 13/11 209/434 |
| 5,447,239 | A * | 9/1995 | Tubbs, Jr. | B03B 5/74 209/434 |
| 5,667,076 | A * | 9/1997 | Rosman | B03B 5/02 209/447 |
| 5,788,293 | A * | 8/1998 | Krenzler | B03B 5/74 209/434 |
| 5,868,366 | A * | 2/1999 | Tubbs, Jr. | B03B 5/74 209/434 |
| 6,095,342 | A * | 8/2000 | Ashcraft | B03B 5/02 209/447 |
| 6,102,211 | A * | 8/2000 | Krenzler | B03B 5/02 15/260 |
| D475,727 | S * | 6/2003 | Kelava | D15/147 |
| 6,988,624 | B2 | 1/2006 | MacNaughton | |
| D663,749 | S * | 7/2012 | Evans | D15/21 |
| 2011/0174699 | A1* | 7/2011 | Friend | B03B 5/02 209/447 |

* cited by examiner

*Primary Examiner* — Joseph C Rodriguez

(57) ABSTRACT

A gold panning assembly for vibrationally separating gold from dirt includes a pan that may receive a mixture of the dirt and the gold. A vibration unit is coupled to the pan. The vibration unit vibrates the pan such that the vibration unit urges the gold to separate from the dirt thereby facilitating the gold to be removed from the dirt.

9 Claims, 3 Drawing Sheets

GOLD PANNING ASSEMBLY

BACKGROUND OF THE DISCLOSURE

Field of the Disclosure

The disclosure relates to panning devices and more particularly pertains to a new panning device for vibrationally separating gold from dirt.

SUMMARY OF THE DISCLOSURE

An embodiment of the disclosure meets the needs presented above by generally comprising a pan that may receive a mixture of dirt and gold. A vibration unit is coupled to the pan. The vibration unit vibrates the pan such that the vibration unit urges the gold to separate from the dirt thereby facilitating the gold to be removed from the dirt.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
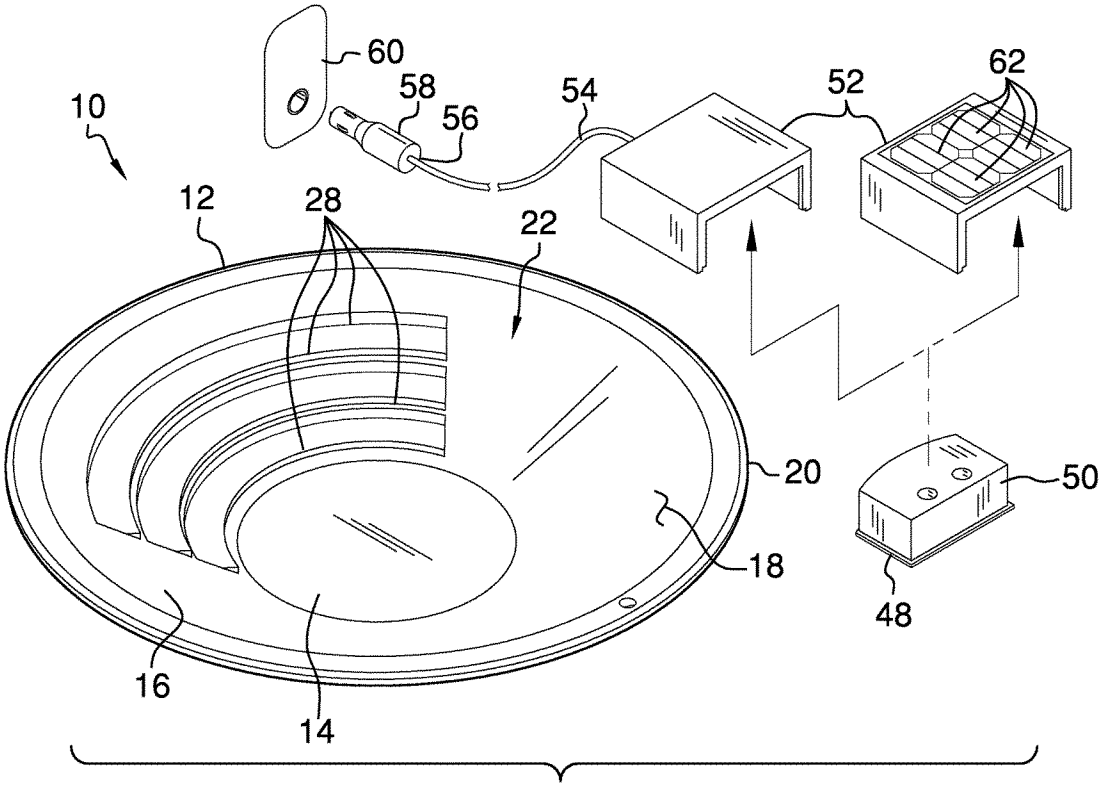
FIG. 1 is a perspective view of a gold panning assembly according to an embodiment of the disclosure.
Figure 2:
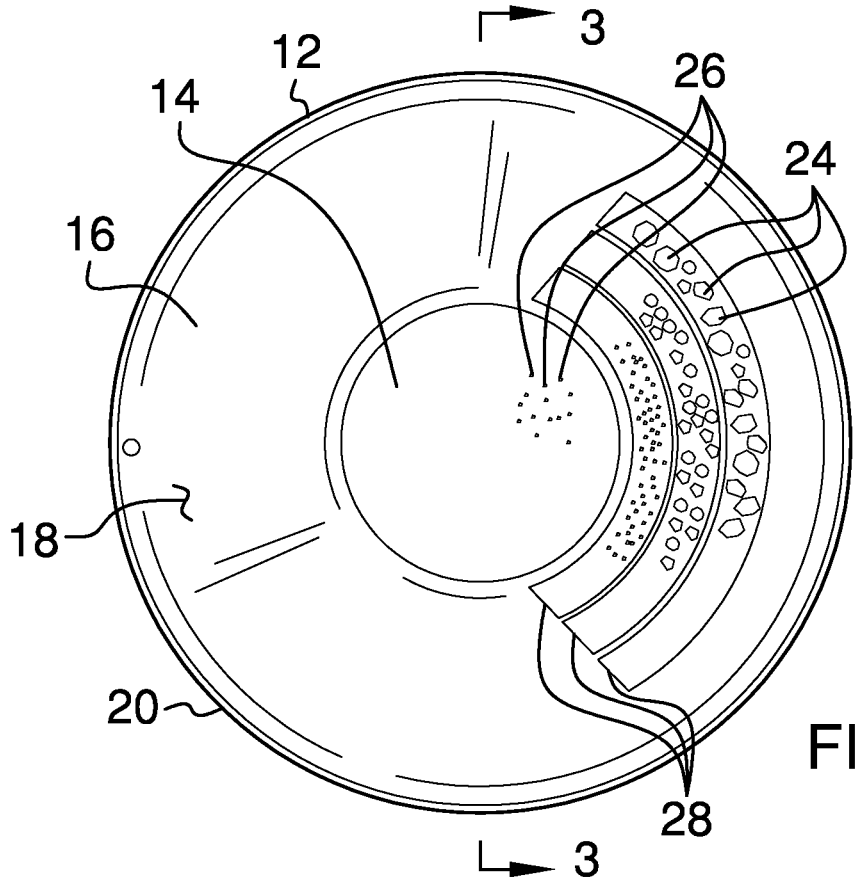
FIG. 2 is a top view of an embodiment of the disclosure.
Figure 3:
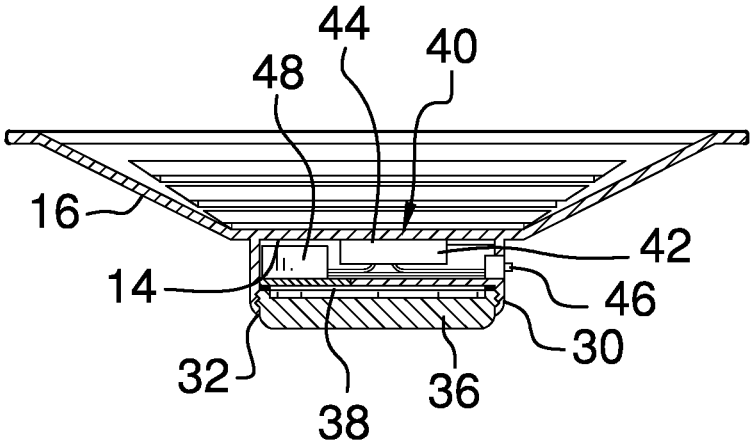
FIG. 3 is a cross sectional view taken along line 3-6 of FIG. 2 of an embodiment of the disclosure.
Figure 4:
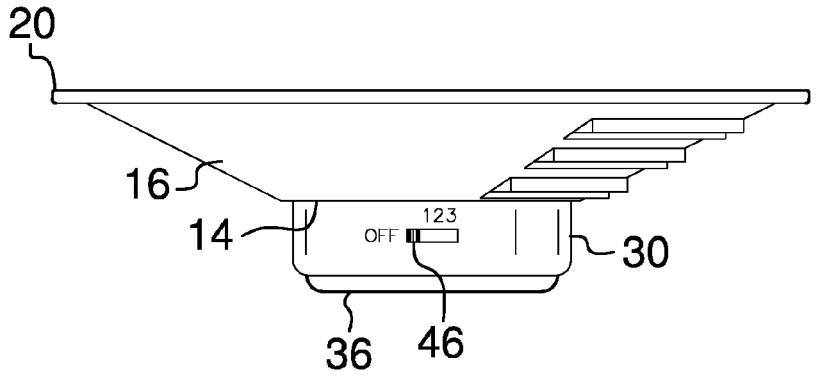
FIG. 4 is a front view of an embodiment of the disclosure.
Figure 5:
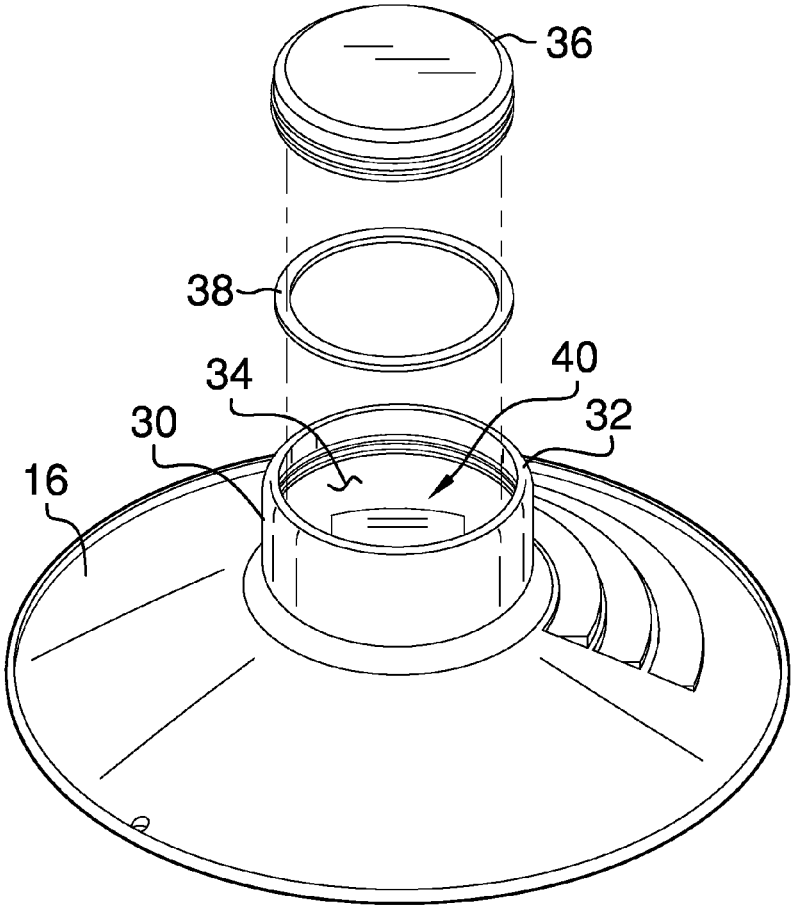
FIG. 5 is a bottom perspective view of an embodiment of the disclosure.

With reference now to the drawings, and in particular to FIGS. 1 through 5 thereof, a new panning device embodying the principles and concepts of an embodiment of the disclosure and generally designated by the reference numeral 10 will be described.

As best illustrated in FIGS. 1 through 5, the gold panning assembly 10 generally comprises a pan 12 that has bottom wall 14 and a peripheral wall 16 extending upwardly from the bottom wall 14. The peripheral wall 16 has an inner surface 18 and a distal edge 20 with respect to the bottom wall 14. The distal edge 20 defines an opening 22 into the pan 12 such that the pan 12 may receive a mixture of dirt 24 and gold 26. The peripheral wall 16 is arcuate such the peripheral wall 16 slopes inwardly between the opening 22 and the bottom wall 14.

The pan 12 has a plurality of ridges 28. Each of the ridges 28 is positioned on the inner surface 18 and each of the ridges 28 is partially coextensive with the peripheral wall 16.

The ridges 28 are spaced apart from each other and are distributed between the distal edge 20 and the bottom wall 14. Thus, each of the ridges 28 captures the mixture of dirt 24 and gold 26.

The pan 12 has a housing portion 30 and the housing portion 30 extends away from the bottom wall 14. The housing portion 30 has a distal edge 32 with respect to the bottom wall 14 and the housing portion 30 is open. The housing portion 30 has an inner surface 34 and the inner surface 34 of the housing portion 30 is threaded. A cover 36 is removably coupled to the housing portion 30. The cover 36 threadably engages the inner surface 34 of the housing portion 30 such that the cover 36 is retained on the housing portion 30. A gasket 38 is positioned between the cover 36 and the housing portion 30 such that the gasket 38 forms a fluid impermeable seal between the cover 36 and the housing portion 30.

A vibration unit 40 is coupled to the pan 12. The vibration unit 40 vibrates the pan 12 such that the vibration unit 40 urges the gold 26 to separate from the dirt 24 thereby facilitating the gold 26 to be removed from the dirt 24. The vibration unit 40 comprises a motor 42 that is positioned within the housing portion 30. The motor 42 may be an electric motor or the like and the motor 42 includes a vibrating member 44. The vibrating member 44 engages the bottom wall 14 such that the vibrating member 44 vibrates the pan 12 when the motor rotates 42. The gold 26 has a weight that is greater than a weight of the dirt 24 such that the gold 26 is agitated more aggressively by the vibration than the dirt 24. Thus, the gold 26 is urged off of the ridges 28 to be deposited on the bottom wall 14 while the dirt 24 remains on the ridges 28.

A switch 46 is coupled to the housing portion 30 and the switch 46 is electrically coupled to the motor 42 such that the switch 46 turns the motor 42 on and off. The switch 46 may manipulated between an off position, a low speed position, a medium speed position and a high speed position. The motor 42 rotates at a minimum speed when the switch 46 is manipulated in the low speed position. The motor 42 rotates at a medium speed when the switch 46 is manipulated in the medium speed position. The motor 42 rotates at a maximum speed when the switch 46 is manipulated in the high speed position.

A power supply 48 is removably positioned within the housing portion 30. The power supply 48 is electrically coupled to the switch 46 when the power supply 48 is positioned within the housing portion 30. The power supply 48 comprises at least one rechargeable battery 50. A charger 52 is provided and the charger 52 insertably receives the power supply 48 when the power supply 48 is removed from the housing portion 30.

The charger 52 may have a cord 54 that is electrically coupled to the charger 52. The cord 52 has a distal end 56 with respect to the charger 52 and the distal end 56 has a plug 58 electrically coupled thereto. The plug 58 may be electrically coupled to a power source 60 thereby facilitating the power supply 48 to be charged. The power source 60 may be an automobile cigarette lighter or the like. The charger 52 may have a plurality of solar cells 62 coupled thereto. The solar cells 62 are electrically coupled to the power supply 48 when the charger 52 insertably receives the power supply 48. The solar cells 62 may be solar cells of any conventional design.

In use, the dirt 24 and gold 26 mixture is deposited on the peripheral wall 16 of the pan 12. The switch 46 is manipulated to actuate the motor 42 to rotate at a selected speed. The vibration unit 40 urges the gold 26 to separate from the dirt 24. The vibration unit 40 eliminates the need to manually agitate the pan 12 to separate the gold 26 from the dirt 24. The power supply 48 is removed from the housing portion 30 and the power supply 48 is positioned in the charger 52 when the power supply 48 becomes depleted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gold panning assembly configured to vibrationally separate gold from dirt, said assembly comprising:

a pan being configured to receive a mixture of the dirt and the gold, said pan having a bottom wall, a housing portion, and a plurality of ridges; and a vibration unit being coupled to said pan, said vibration unit vibrating said pan wherein said vibration unit is configured to urge the gold to separate from the dirt thereby facilitating the gold to be removed from the dirt, said vibration unit comprising a motor being positioned within said housing portion, said motor including a vibrating member, said vibrating member engaging said bottom wall wherein said vibrating member is configured to vibrate said pan when said motor rotates thereby facilitating the gold to be deposited on said bottom wall while the dirt remains on said ridges.

2. The assembly according to claim 1, wherein said pan has a bottom wall and a peripheral wall extending upwardly from said bottom wall, said peripheral wall having an inner surface and a distal edge with respect to said bottom wall, said distal edge defining an opening into said pan, said peripheral wall being arcuate such said peripheral wall slopes inwardly between said opening and said bottom wall.

3. The assembly according to claim 2, wherein said pan has a plurality of ridges, each of said ridges being positioned on said inner surface, each of said ridges being partially coextensive with said peripheral wall, said ridges being spaced apart from each other and distributed between said distal edge and said bottom wall wherein each of said ridges is configured to capture the mixture of dirt and gold.

4. The assembly according to claim 3, wherein said pan has a housing portion, said housing portion extending away from said bottom wall, said housing portion having a distal edge with respect to said bottom wall, said housing portion being open, said housing portion having an inner surface, said inner surface of said housing portion being threaded.

5. The assembly according to claim 4, further comprising a cover being removably coupled to said housing portion, said cover threadably engaging said inner surface of said housing portion such that said cover is retained on said housing portion.

6. The assembly according to claim 5, further comprising a gasket being positioned between said cover and said housing portion wherein said gasket is configured to form a fluid impermeable seal between said cover and said housing portion.

7. The assembly according to claim 1, further comprising a switch being coupled to said housing portion, said switch being electrically coupled to said motor such that said switch turns said motor on and off.

8. The assembly according to claim 7, further comprising a power supply being positioned within said housing portion, said power supply being electrically coupled to said switch, said power supply comprising at least one battery.

9. A gold panning assembly configured to vibrationally separate the gold from dirt, said assembly comprising:

a pan having a bottom wall and a peripheral wall extending upwardly from said bottom wall, said peripheral wall having an inner surface and a distal edge with respect to said bottom wall, said distal edge defining an opening into said pan wherein said pan is configured to receive a mixture of the dirt and the gold, said peripheral wall being arcuate such said peripheral wall slopes inwardly between said opening and said bottom wall, said pan having a plurality of ridges, each of said ridges being positioned on said inner surface, each of said ridges being partially coextensive with said peripheral wall, said ridges being spaced apart from each other and distributed between said distal edge and said bottom wall wherein each of said ridges is configured to capture the mixture of dirt and gold, said pan having a housing portion, said housing portion extending away from said bottom wall, said housing portion having a distal edge with respect to said bottom wall, said housing portion being open, said housing portion having an inner surface, said inner surface of said housing portion being threaded;

a cover being removably coupled to said housing portion, said cover threadably engaging said inner surface of said housing portion such that said cover is retained on said housing portion;

a gasket being positioned between said cover and said housing portion wherein said gasket is configured to form a fluid impermeable seal between said cover and said housing portion;

a vibration unit being coupled to said pan, said vibration unit vibrating said pan wherein said vibration unit is configured to urge the gold to separate from the dirt thereby facilitating the gold to be removed from the dirt, said vibration unit comprising:

a motor being positioned within said housing portion, said motor including a vibrating member, said vibrating member engaging said bottom wall wherein said vibrating member is configured to vibrate said pan when said motor rotates thereby facilitating the gold to be deposited on said bottom wall while the dirt remains on said ridges, a switch being coupled to said housing portion, said switch being electrically coupled to said motor such that said switch turns said motor on and off, and a power supply being positioned within said housing portion, said power supply being electrically coupled to said switch, said power supply comprising at least one battery.

* * * * *